US010619956B1

(12) United States Patent
Zhang

(10) Patent No.: US 10,619,956 B1
(45) Date of Patent: Apr. 14, 2020

(54) BUFFER ASSEMBLY FOR FIREARM

(71) Applicant: Hong Jun Zhang, City of Industry, CA (US)

(72) Inventor: Hong Jun Zhang, City of Industry, CA (US)

(73) Assignee: Trinity Force Corporation(USA), City of Industry, CA (US)

( * ) Notice: Subject to any disclaimer, the term of this patent is extended or adjusted under 35 U.S.C. 154(b) by 0 days.

(21) Appl. No.: 16/392,617

(22) Filed: Apr. 23, 2019

(51) Int. Cl.
*F41A 3/84* (2006.01)

(52) U.S. Cl.
CPC ..... *F41A 3/84* (2013.01)

(58) Field of Classification Search
None
See application file for complete search history.

(56) References Cited

U.S. PATENT DOCUMENTS 640,541 A * 1/1900 Dawson et al. ..... F41A 3/82
6,829,974 B1 * 12/2004 Gwinn, Jr. ..... F41A 3/70 89/130
2013/0319217 A1 * 12/2013 Gangl ..... F41A 3/84 89/198

* cited by examiner

*Primary Examiner* — Stephen Johnson
(74) *Attorney, Agent, or Firm* — Raymond Y. Chan; David and Raymond Patent Firm

(57) ABSTRACT

A buffer assembly includes a stopper supported at a rear end of an extension tube of a firearm, a buffer slidably supported at a front end of the extension tube, and a coil spring. The coil spring has an outer diameter slightly smaller than an inner diameter of the extension tube to maximize a diameter size of the coil spring. The coil spring has a front end coupled at a front end of the buffer and a rear end coupled at a rear end of the stopper to maximize a length of the coil spring. The buffer is slid within the extension tube in a linear manner that the coil spring urges the buffer at the forward-most position of the extension tube. When the buffer is pushed rearweadly in a linear slidable manner to compress the coil spring, the coil spring pushes the buffer back to its initial position.

2 Claims, 4 Drawing Sheets

BUFFER ASSEMBLY FOR FIREARM

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a firearm, and more particularly to a buffer assembly for a firearm, wherein a dimension of a coil spring is maximized within the extension tube of the firearm to enhance the strength of the coil spring so as to ensure a linear sliding movement of the buffer along the extension tube.

Description of Related Arts

It is known that the buffering device is one of the important components for smoothly operating a rifle, especially for the AR-15 rifle. Accordingly, each time the rifle is cocked or a round is fired, the bolt carrier of the rifle has to follow through an action to load a round into the chamber of the rifle. The buffering device is a recoil management system which comprises a coil spring to cycle the action.

U.S. Pat. No. 8,800,424, Gangl, et al. disclosed a captured spring assembly for a firearm, wherein the assembly comprises a guide rod coaxially supported within an extension tube of the firearm, and a bolt return spring encircling the guide rod, wherein the bolt return spring is sandwiched between a rear of the slider of a buffer and a front of a resilient portion of the shock absorber. Accordingly, in the battery position of the rifle, the bolt return spring urges the buffer forward. In the out of battery position of the rifle, the buffer is pushed rearwardly to fully compress the bolt return spring between the buffer and the shock absorber. Then, the compressed bolt return spring will push the buffer forward back to the battery position. It is worth mentioning that the bolt return spring will apply a spring force against the buffer to slow down the rearward sliding movement of the buffer. However, the captured spring assembly as taught by Gangl et al. has several drawbacks.

The diameter of the bolt return spring is relatively small comparing to the diameter of the extension tube. Accordingly, each of the buffer and the shock absorber has a hollow structure to connect the bolt return spring. Particularly, the buffer has a front closed end and a rear opened end. The shock absorber has a front opened end and a rear closed end. Therefore, the front end portion of the bolt return spring is inserted into the rear opened end of the buffer while the rear end portion of the bolt return spring is inserted into the front opened end of the shock absorber. In other words, the connection configuration of the buffer and the shock absorber will limit the diameter size of the bolt return spring.

The length of the bolt return spring is relatively short comparing to the length of the extension tube. Accordingly, the length of the bolt return spring is limited by the distance between the buffer and the shock absorber. Even though the end portions of the bolt return spring are inserted into the buffer and the shock absorber respectively, the effective compression portion of the bolt return spring is defined between the rear of the buffer and the front of the shock absorber. In other words, the effective compression portion of the bolt return spring is shorter than the actual length thereof.

As the dimension, i.e. the diameter and length, of the bolt return spring is restricted, spring rate thereof will be substantially reduced. In order to enhance the strength of the bolt return spring, the bolt return spring must be made of high-end material. However, the manufacturing cost of the captured spring assembly will be highly increased. In addition, the slimmer and shorter bolt return spring cannot provide the rearward sliding movement of the buffer in a stabilized manner, such that the buffer will be vibrated during the rear sliding movement thereof. In other words, the bolt return spring cannot provide a linear sliding movement of the buffer. Furthermore, the length of the bolt return spring being compressed is relatively small comparing to the length thereof before compressed because two ends of the bolt return spring are biased against the rear of the buffer and the front the shock absorber. In other words, the traveling distance of the buffer is limited along the extension tube.

SUMMARY OF THE PRESENT INVENTION

The invention is advantageous in that it provides a buffer assembly for a firearm, wherein a dimension of a coil spring is maximized within the extension tube of the firearm to enhance the strength of the coil spring so as to ensure a linear sliding movement of the buffer along the extension tube.

Another advantage of the invention is to a buffer assembly, wherein a diameter size of the coil spring is maximized by matching an outer diameter of the coil spring with an inner diameter of the extension tube to enhance the strength the coil spring within the extension tube.

Another advantage of the invention is to a buffer assembly, wherein a length size of the coil spring is maximized by coupling a front end of the coil spring at a front end of the buffer and by coupling a rear end of the coil spring at a rear end of the stopper, such that the maximized length of the coil spring will further enhance the strength the coil spring within the extension tube.

Another advantage of the invention is to a buffer assembly, wherein a length size of the coil spring is minimized when it is compressed to prolong a traveling distance of the buffer within the extension tube.

Another advantage of the invention is to a buffer assembly, wherein the buffer has a guiding channel to slidably engage with the guiding member to further ensure the linear sliding movement of the buffer.

Another advantage of the invention is to a buffer assembly, which has a simple structure to provide a buffering feature for the firearm.

Another advantage of the invention is to provide a buffer assembly, which does not require altering the original structural design of the extension tube and the firearm, so as to minimize the manufacturing cost of the buffer assembly incorporating with the extension tube.

Another advantage of the invention is to a buffer assembly, wherein no expensive or complicated structure is required to employ in the present invention in order to achieve the above mentioned objects. Therefore, the present invention successfully provides an economic and efficient solution for providing a simple and effective buffering configuration for the firearm.

Additional advantages and features of the invention will become apparent from the description which follows, and may be realized by means of the instrumentalities and combinations particular point out in the appended claims.

According to the present invention, the foregoing and other objects and advantages are attained by a buffer assembly for a firearm having an extension tube. The buffer assembly comprises a stopper arranged for being supported at a rear end of the extension tube and a buffer arranged for being slidably supported at a front end of the extension tube.

The buffer assembly further comprises a coil spring coaxially supported within the extension tube. The coil spring has an outer diameter slightly smaller than an inner diameter of the extension tube to maximize a diameter size of the coil spring within the extension tube. The coil spring has a front end coupled at a front end of said buffer and a rear end coupled at a rear end of the stopper to maximize a length of the coil spring within the extension tube. The buffer is guided for being slid within the extension tube in a linear manner between a first position and a second position. At the first position, the coil spring urges the buffer at the forwardmost position of the extension tube. At the second position, the buffer is pushed rearweadly in a linear slidable manner to compress the coil spring, such that the coil spring then pushes the buffer back to the first position.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
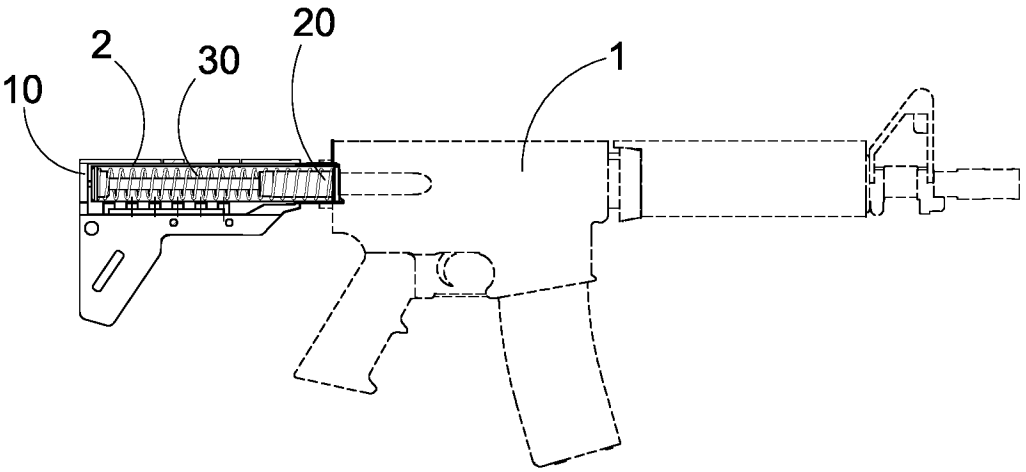
FIG. 1 is a schematic view of a firearm incorporated with a buffer assembly according to a preferred embodiment of the present invention, illustrating the firearm in a battery position.
Figure 2:
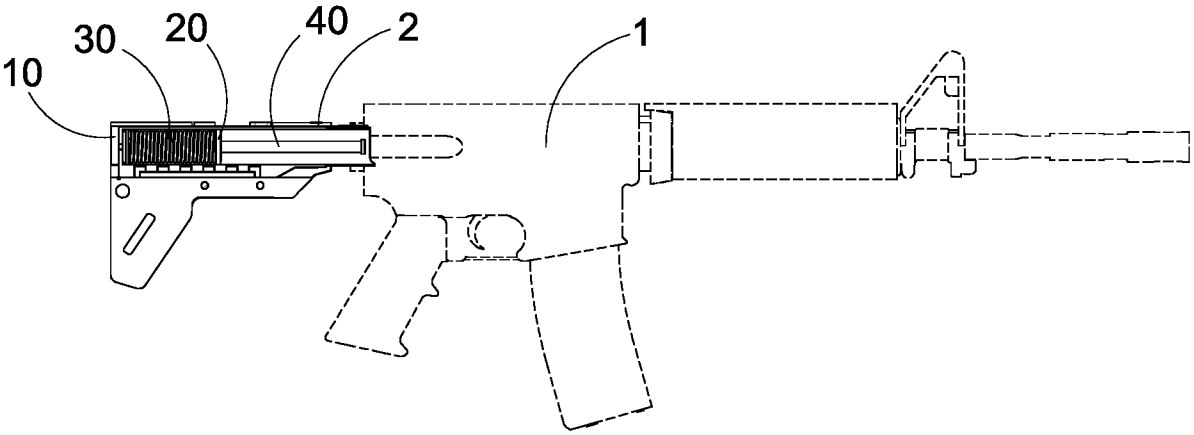
FIG. 2 is a schematic view of the firearm incorporated with the buffer assembly according to a preferred embodiment of the present invention, illustrating the firearm in an out of battery position.
Figure 3:
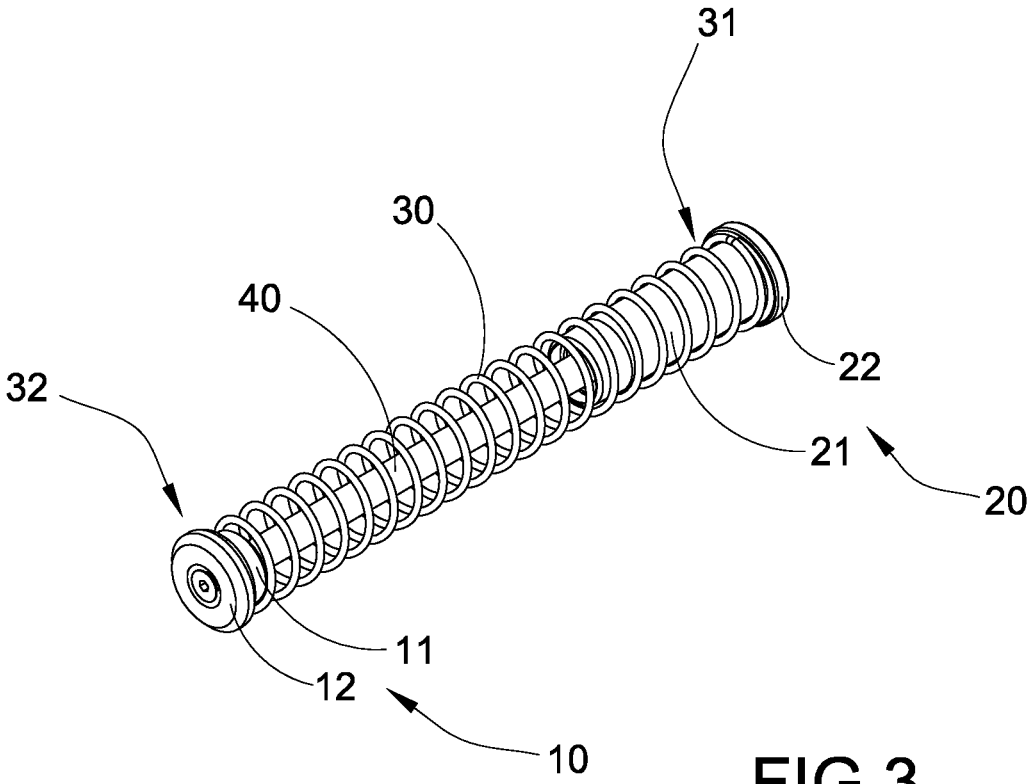
FIG. 3 is a perspective view of the buffer assembly according to the preferred embodiment of the present invention.
Figure 7:
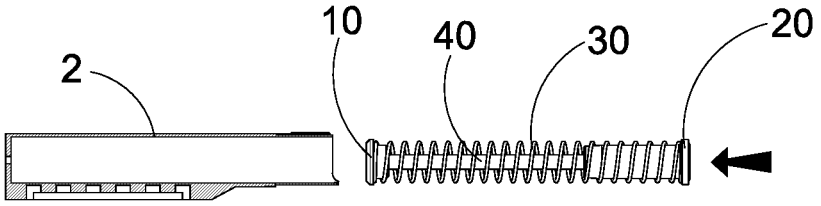
FIG. 7 illustrates the buffer assembly being installed into the extension tube of the firearm according to the preferred embodiment of the present invention.

Referring to FIGS. 1 and 2 of the drawings, a buffer assembly for a firearm according to a preferred embodiment of the present invention is illustrated, wherein the firearm is operated between a battery position and an out of batter position as shown in FIGS. 1 and 2. In one example, the firearm 1 is embodied as a rifle to have an extension tube 2 extended rearwardly, wherein the buffer assembly is installed into the extension tube 2 as shown in FIG. 7.

As shown in FIGS. 3 to 9, the buffer assembly comprises a stopper 10 supported at a rear end of the extension tube 2 and a buffer 20 supported at a front end of the extension tube 2. It is worth mentioning that the front end of the extension tube 2 is coupled at a rear end of the firearm 1.

The buffer assembly further comprises a coil spring 30 coaxially supported within the extension tube 2. The coil spring 30 has an outer diameter slightly smaller than an inner diameter of the extension tube 2 to maximize a diameter size of the coil spring 30 within the extension tube 2. The coil spring 30 has a front end 31 coupled at a front end of the buffer 20 and a rear end 32 coupled at a rear end of the stopper 10 to maximize a length of the coil spring 30 within the extension tube 30.

Figure 5:
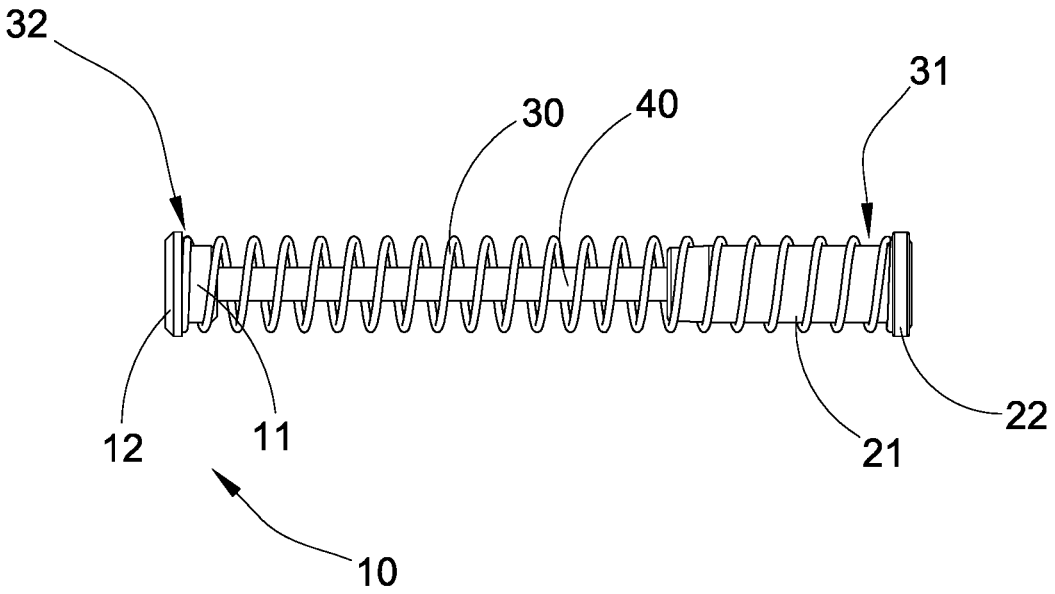
FIG. 5 is a side view of the buffer assembly according to the preferred embodiment of the present invention, illustrating the first position of the buffer.
Figure 6:
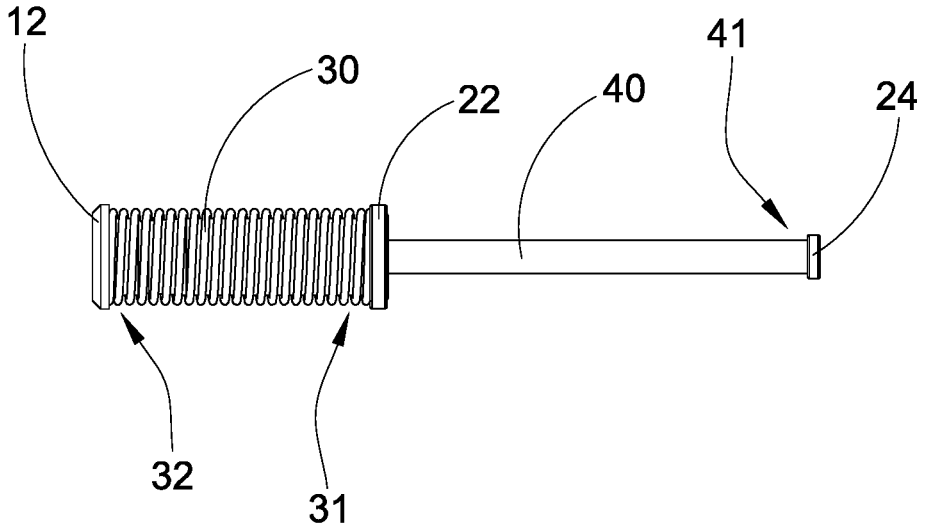
FIG. 6 is a side view of the buffer assembly according to the preferred embodiment of the present invention, illustrating the second position of the buffer.
Figure 8:
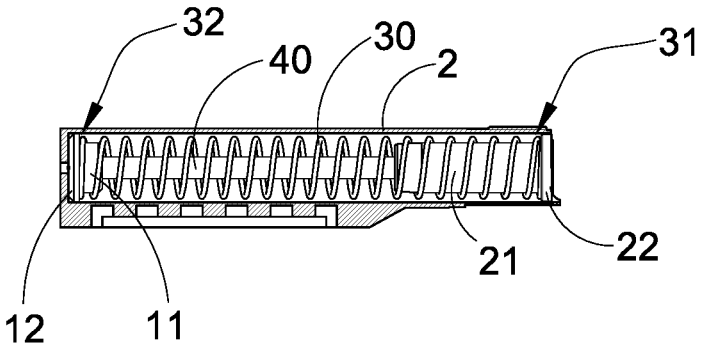
FIG. 8 is a side view of the buffer assembly according to the preferred embodiment of the present invention, illustrating the first position of the buffer within the extension tube.
Figure 9:
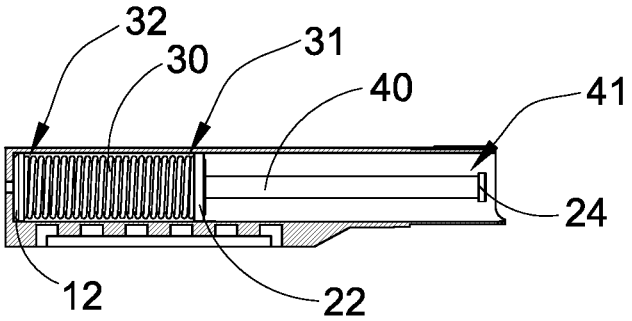
FIG. 9 is a side view of the buffer assembly according to the preferred embodiment of the present invention, illustrating the second position of the buffer within the extension tube.

Accordingly, the buffer 20 is guided for being reciprocatingly slid within the extension tube 2 in a linear manner between a first initial position and a second position. At the first position, as shown in FIGS. 1, 5 and 8, the coil spring 30 urges the buffer 20 at the forwardmost position of the extension tube 2 in response to the battery position of the firearm 1. At the second position, as shown in FIGS. 2, 6 and 9, the buffer 20 is pushed rearweadly in a linear slidable manner to compress the coil spring 30 in response to the out of battery position of the firearm 1. The coil spring 30 then pushes the buffer 20 back to the first initial position.

The buffer assembly further comprises an elongated guiding member 40 coaxially supported within the extension tube 2 and extended from the stopper 10 to slidably couple to the buffer 20 to guide a linear sliding movement of the buffer 20 between the first position and the second position.

As shown in FIGS. 8 and 9, the stopper 10 is coaxially supported within the extension tube 2 and is affixed at the rear end of the extension tube 2 in an immovable manner. Therefore, once the buffer assembly is installed into the extension tube 2, the stopper 2 will not be moved along the extension tube 2.

Figure 4:
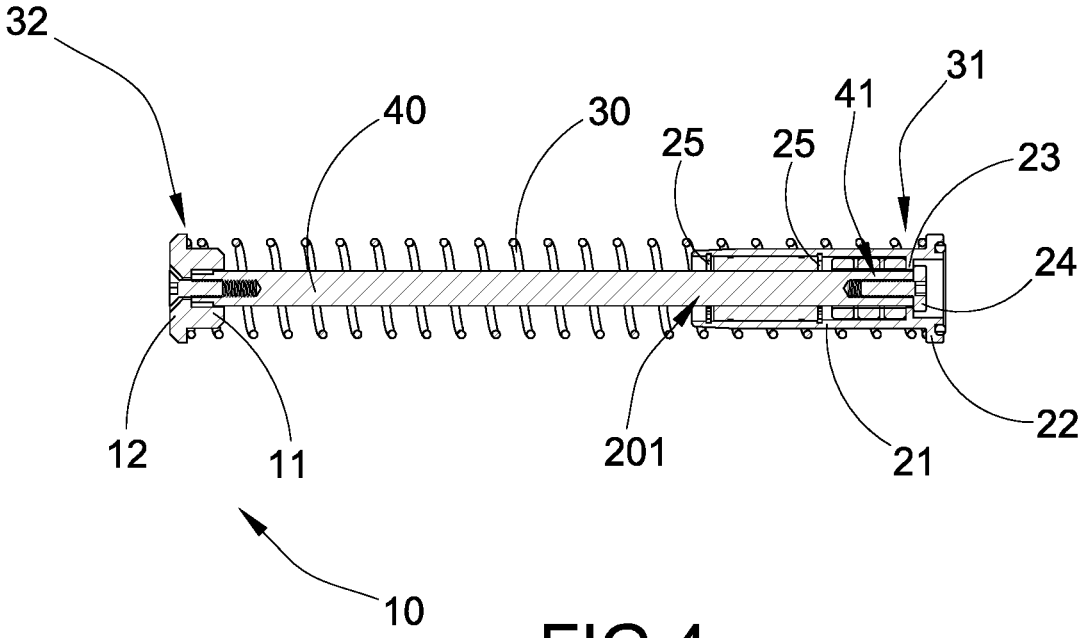
FIG. 4 is a sectional view of the buffer assembly according to the preferred embodiment of the present invention.

As shown in FIG. 4, the stopper 10 comprises a stopper body 11 having a diameter smaller than an inner diameter of the coil spring 30 and a stopper retention ring 12 outwardly extended from a rear end of the stopper body 11. Accordingly, the stopper retention ring 12 is radially, integrally, and outwardly extended from the rear end of the stopper body 11, such that the diameter of the stopper retention ring 12 is larger than the diameter of the stopper body 11. Particularly, the diameter of the stopper retention ring 12 is larger than the inner diameter of the coil spring 30. The stopper body 11 is slidably inserted into the rear end 32 of the coil spring 30 until the rear end 32 of the coil spring 30 urges the stopper retention ring 12. The thickness of the stopper retention ring 12 is smaller than the thickness of the stopper body 11, such that the thickness of the stopper retention ring 12 is minimized to ensure the rear end 32 of the coil spring 30 extending close to the rear end of the extension tube 2.

According to the preferred embodiment, the buffer 20 comprises a buffer body 21 having a diameter smaller than the inner diameter of the coil spring 30 and a buffer retention ring 22 outwardly extended from a front end of the buffer body 21. Accordingly, the buffer retention ring 22 is radially, integrally, and outwardly extended from the front end of the buffer body 21, such that the diameter of the buffer retention ring 22 is larger than the diameter of the buffer body 21. Particularly, the diameter of the buffer retention ring 22 is larger than the inner diameter of the coil spring 30. The buffer body 21 is inserted into the front end 31 of the coil spring 30 until the front end 31 of the coil spring 30 urges the buffer retention ring 22. The thickness of the buffer retention ring 22 is smaller than the thickness of the buffer body 21, such that the thickness of the buffer retention ring 22 is minimized to ensure the front end 31 of the coil spring 30 extending close to the front end of the extension tube 2.

It is worth mentioning that the coil spring 30 is retained between the stopper retention ring 12 and the buffer retention ring 22 to maximize the length of the coil spring 30 for matching with the length of the extension tube 2. Preferably, the front end 31 of the coil spring 30 is affixed to the buffer retention ring 21 of the buffer 20 and the rear end 32 of the coil spring 30 is affixed to the stopper retention ring 12 of the stopper 10. Furthermore, the coil spring 30 has a uniform outer diameter between the front and rear ends 31, 32.

According to the preferred embodiment, a rear end of the guiding member 40 is affixed at the stopper 10, wherein the buffer 20 is slidably coupled at the guiding member 40 to enable the buffer 20 sliding between the front end 41 and the rear end of the guiding member 40. Preferably, a diameter of the guiding member 40 is smaller than the diameter of the stopper body 11 and is smaller than the diameter of the buffer body 21. In other words, the rear end of the guiding member 40 is an affixing end affixed to the stopper 10 while the front end 41 of the guiding member 40 is a free end to slidably couple at the buffer 20.

As shown in FIG. 4, the buffer body 21 has a tubular structure that the guiding member 40 is extended through the buffer body 21 for ensuring the buffer 20 being slid within the extension tube 2. Particularly, the buffer body 21 has a front opened end and a rear opened end for the guiding member 40 passing from the rear opened end to the front opened end.

At the first position of the buffer 20, the buffer 20 is pushed by the coil spring 30 and is located at the front end of the extension tube 2, wherein the front end 41 of the guiding member 40 is located and enclosed within the buffer 20. At the second position of the buffer 20, the coil spring 30 is compressed when the buffer 20 is slid along the guiding member 40 toward the rear end thereof, i.e. toward the stopper 10 at the rear end of the extension tube 2. Once the buffer 20 is moved toward the stopper 10 along the guiding member 40, the front end 41 of the guiding member 40 is exposed out of the buffer 20.

As shown in FIG. 4, the buffer 20 further comprises a buffer limited ring 23 to limit the sliding movement of the buffer 20 at the front end 41 of the guiding member 40. The buffer limited ring 23 is inwardly extended from an inner wall of the buffer body 21 between the front opened end and the rear opened end to bias against the front end 41 of the guiding member 40 so as to retain the buffer 20 at the first position. Accordingly, an outer edge of the buffer limited ring 23 is integrally extended from the inner wall of the buffer body 21 and an inner edge of the buffer limited ring 23 forms a through slot for the guiding member 40 passing therethrough. In other words, an inner diameter of the buffer limited ring 23, i.e. a diameter of the through slot, is slightly larger than the diameter of the guiding member 40.

The buffer 20 further comprises a retention fastener 24 detachably coupled at the front end 41 of the guiding member 40 to block the buffer 20 being slid out of the front end 41 of the guiding member 40. Preferably, the retention fastener 24 is a screw having an enlarged head portion coaxially coupled at the front end 41 of the guiding member 40. Accordingly, the inner diameter of the buffer limited ring 23 is smaller than a diameter of the retention fastener 24, such that the buffer 20 is pushed forward along the guiding member 40 by the coil spring 30 until the buffer limited ring 23 is stopped at the retention fastener 24, i.e. the front end 41 of the guiding member 40. In other words, the buffer 20 is adapted to slide forward along the guiding member 40 until the buffer 20 is stopped at the front end 41 of the guiding member 40 so as to prevent the buffer 20 being slid out of the front end 41 of the guiding member 40.

It is worth mentioning that the front end 41 of the guiding member 40 is retained between the buffer limited ring 23 and the front opened end of the buffer body 21, wherein the buffer limited ring 23 is located close to the front opened end of the buffer body 21 to maximize the length of the guiding member 40 so as to prolong the traveling distance of the buffer 20.

The buffer 20 further has a guiding channel 201 formed within the buffer body for the guiding member 40 slidably passing through the guiding channel 201, so as to further ensure the linear sliding movement of the buffer 20. Accordingly, the guiding channel 201 has a diameter slightly larger than the diameter of the guiding member 40 to guide the sliding movement of the buffer 20 in a stabilized manner. It is worth mentioning that the guiding channel 201 is coaxially formed at a center of the buffer 20 to ensure the guiding member 40 being coaxially extended through the buffer 20.

In one embodiment, the buffer 20 further comprises two or more guiding plates 25 spacedly formed within the buffer body 21, wherein the guiding plates 25 are located between the rear opened end of the buffer body 21 and the buffer limited ring 23. Preferably, the guiding plates 25 are parallel with each other and are integrally extended from the inner wall of the buffer body 21. Each of the guiding plates 25 has a center aperture which is coaxially formed at the center of the buffer body 20 and is aligned with the through slot of the buffer limited ring 23. Accordingly, the center apertures of the guiding plates 25 are coaxially aligned with each other to form the guiding channel 201, such that the guiding member 40 is slidably extended through the center apertures of the guiding plates 25 to guide the sliding movement of the buffer 20 along the guiding member 40. Therefore, the buffer 20 provides a three-point alignment, i.e. the inner edge of the buffer limited ring 23 and two inner edges of the guiding plates 25, to ensure the sliding movement of the buffer 20 along the guiding member 40 in a stabilize manner.

In order to install the buffer assembly, the rear end of the guiding member 40 is affixed to the stopper 10. The coil spring 30 is slid to coaxially encircle the guiding member 40 until the rear end 32 of the coil spring 30 is coupled at the stopper retention ring 11. Then, the front end 41 of the guiding member 40 is extended through the guiding channel 201 until the front end 41 of the guiding member 40 passes the buffer limited ring 23. At the same time, the buffer body 21 is slidably inserted into the front end 31 of the coil spring 30 until the front end 31 of the coil spring 30 urges the buffer retention ring 22. Then, the retention fastener 24 passes through the front opened end of the buffer body 21 to detachably couple at the front end 41 of the guiding member 40 so as to lock up the buffer 20 at the guiding member 40 from being slid out thereof. Accordingly, the coil spring 30 is retained between the front end of the buffer 20 and the rear end of the stopper 10, wherein the front end 31 of the coil spring 30 urges the buffer retention ring 22 of the buffer 20 while the rear end 32 of the coil spring 30 urges the stopper retention ring 12 of the stopper 10. Preferably, the coil spring 30 is slightly compressed between the buffer retention ring 22 of the buffer 20 and the stopper retention ring 12 of the stopper 10. Therefore, the buffer assembly is able to slide into the extension tube 2 as shown in FIG. 7.

At the battery position of the firearm 1, as shown in FIG. 1, the coil spring 30 urges the buffer 20 at the forwardmost position of the extension tube 2, i.e. the first position of the buffer 20. At the out of battery position of the firearm 1, as shown in FIG. 2, the buffer 20 is pushed backward and is slid toward the stopper 10 within the extension tube 2. By maximizing the diameter size and length of the coil spring 30 within the extension tube 2, the buffer 20 is guided to reciprocatingly slide in a linear sliding movement to minimize the unwanted vibration of the buffer 20 during the sliding movement thereof.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A buffer assembly for a firearm having an extension tube, comprising:

a stopper arranged for being supported at a rear end of the extension tube;

a buffer arranged for being slidably supported at a front end of the extension tube;

a coil spring having an outer diameter smaller than an inner diameter of the extension tube to maximize a diameter size of said coil spring within the extension tube, wherein said coil spring has a front end coupled at a front end of said buffer and a rear end coupled at said rear end of said stopper to maximize a length of said coil spring within the extension tube, wherein said buffer is guided for being slid within the extension tube in a linear manner between a first position and a second position, wherein at said first position, said coil spring urges said buffer at a forwardmost position of the extension tube, and at said second position, said buffer is pushed rearweadly in a linear slidable manner to compress said coil spring, such that said coil spring then pushes said buffer back to said first position; and an elongated guiding member extended from said stopper to slidably couple to said buffer to guide a linear sliding movement of said buffer between said first position and said second position, wherein said buffer comprises a buffer body having a diameter smaller than an inner diameter of said coil spring and a buffer retention ring outwardly extended from a front end of said buffer body, such that said buffer body is inserted into said front end of said coil spring until said front end of said coil spring urges said buffer retention ring, wherein said buffer body has a tubular structure that said guiding member is extended through said buffer body for ensuring said buffer being slid within the extension tube, wherein said buffer further has a guiding channel formed within said buffer body for said guiding member slidably passing through said guiding channel, wherein said guiding channel has a diameter slightly lamer than a diameter of said guiding member to guide the sliding movement of said buffer, wherein said buffer further comprises two or more guiding plates spacedly formed within said buffer body, wherein each of said guiding plates has a center aperture that said center apertures are coaxially aligned with each other to form said guiding channel, such that said guiding member is slidably extended through said center apertures of said guiding plates to guide the sliding movement of said buffer along said guiding member.

2. A buffer assembly for a firearm having an extension tube, comprising:

a stopper arranged for being supported at a rear end of the extension tube;

a buffer arranged for being slidably supported at a front end of the extension tube;

a coil spring having an outer diameter smaller than an inner diameter of the extension tube to maximize a diameter size of said coil spring within the extension tube, wherein said coil spring has a front end coupled at a front end of said buffer and a rear end coupled at said rear end of said stopper to maximize a length of said coil spring within the extension tube, wherein said buffer is guided for being slid within the extension tube in a linear manner between a first position and a second position, wherein at said first position, said coil spring urges said buffer at a forwardmost position of the extension tube, and at said second position, said buffer is pushed rearweadly in a linear slidable manner to compress said coil spring, such that said coil spring then pushes said buffer back to said first position; and an elongated guiding member extended from said stopper to slidably couple to said buffer to guide a linear sliding movement of said buffer between said first position and said second position, wherein said buffer comprises a buffer body having a diameter smaller than an inner diameter of said coil spring and a buffer retention ring outwardly extended from a front end of said buffer body, such that said buffer body is inserted into said front end of said coil spring until said front end of said coil spring urges said buffer retention ring, wherein said buffer body has a tubular structure that said guiding member is extended through said buffer body for ensuring said buffer being slid within the extension tube, wherein said buffer body has a front opened end and a rear opened end for said guiding member passing from said rear opened end to said front opened end, and a buffer limited ring inwardly extended from an inner wall of said buffer body between said front opened end and said rear opened end to bias against a front end of said guiding member so as to retain said buffer at said first position, wherein said buffer further comprises a retention fastener detachably coupled at said front end of said guiding member, wherein an inner diameter of said buffer limited ring is slightly larger than a diameter of said guiding member and is smaller than a diameter of said retention fastener, such that said buffer is pushed forward along said guiding member by said coil spring until said buffer limited ring is stopped at said retention fastener, wherein said buffer further has a guiding channel formed within said buffer body for said guiding member slidably passing through said guiding channel, wherein said guiding channel has a diameter slightly larger than a diameter of said guiding member to guide the sliding movement of said buffer, wherein said buffer further comprises two or more guiding plates spacedly formed within said buffer body, wherein each of said guiding plates has a center aperture that said center apertures are coaxially aligned with each other to form said guiding channel, such that said guiding member is slidably extended through said center apertures of said guiding plates to guide the sliding movement of said buffer along said guiding member.

* * * * *